United States Patent [19]

Cheng

[11] Patent Number: 4,822,648

[45] Date of Patent: Apr. 18, 1989

[54] DECORATIVE BOW ASSEMBLY AND METHOD OF MAKING SAME

[76] Inventor: Peter S. C. Cheng, 5 Ross Street, Toronto, Ontario, Canada, M5T 1Z8

[21] Appl. No.: 103,353

[22] Filed: Oct. 1, 1987

[51] Int. Cl.[4] ..... D04D 7/10

[52] U.S. Cl. ..... 428/4; 223/46; 428/101; 428/136

[58] Field of Search ..... 428/4, 5, 101, 136; 223/46

[56] References Cited

U.S. PATENT DOCUMENTS

| | | | |
|---|---|---|---|
| 2,841,905 | 7/1958 | Wanchek | 428/5 |
| 3,256,129 | 6/1966 | Wallerstein et al. | 428/5 |
| 3,283,339 | 11/1966 | Heifetz | 428/4 X |
| 3,954,212 | 5/1976 | Bolis | 428/4 X |
| 4,476,168 | 10/1984 | Aoyama | 428/4 |
| 4,515,837 | 5/1985 | Cheng | 428/4 |
| 4,608,283 | 8/1986 | White | 428/4 |
| 4,656,064 | 4/1987 | Cheng | 428/101 X |

*Primary Examiner*—Henry F. Esptein

*Attorney, Agent, or Firm*—Kirschstein, Kirschstein, Ottinger & Israel

[57] ABSTRACT

A decorative pull bow has multiple loops formed from a pair of bow members having bow sections which are slit to form multiple loop-forming elements. The bow members and a drawstring are shorter in length than heretofore without sacrificing the number of loops in the formed bow. The drawstring has a short pull stroke. The loops are automatically angularly arranged about a central longitudinal axis.

11 Claims, 2 Drawing Sheets

FIG. 1
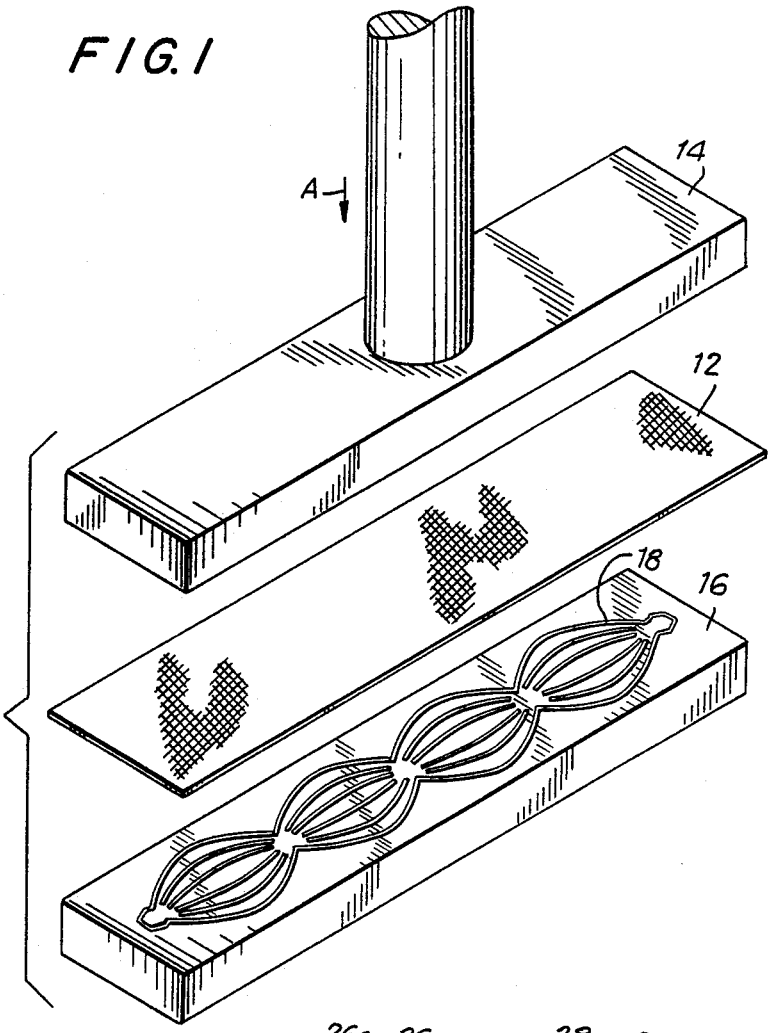
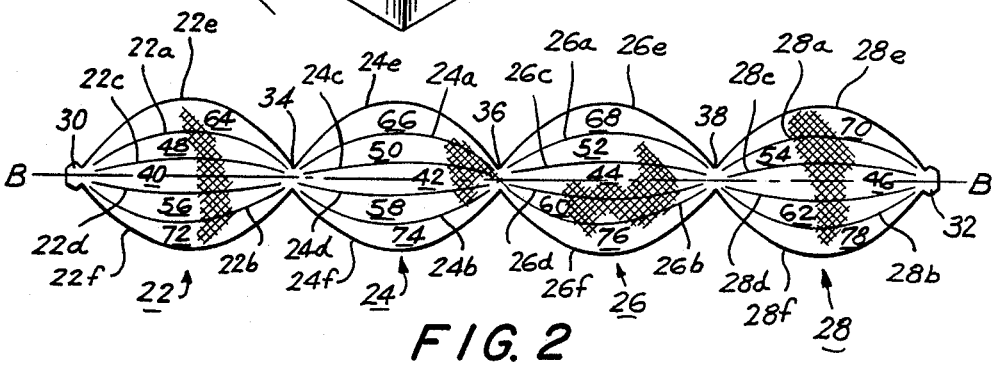
FIG. 2

FIG. 3
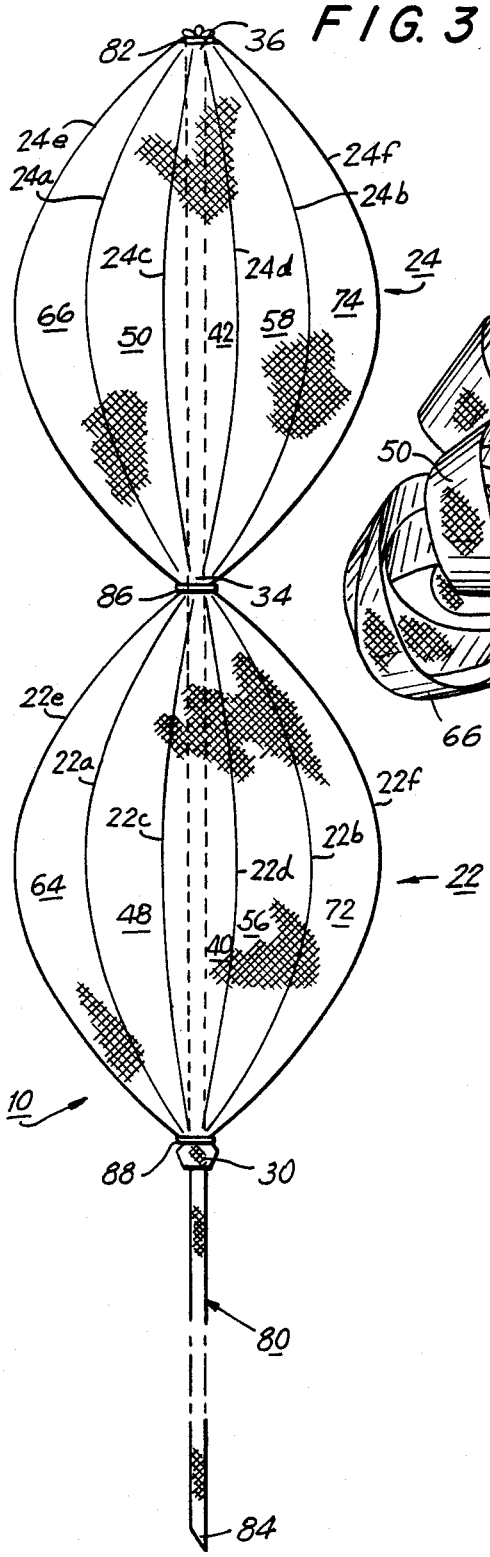
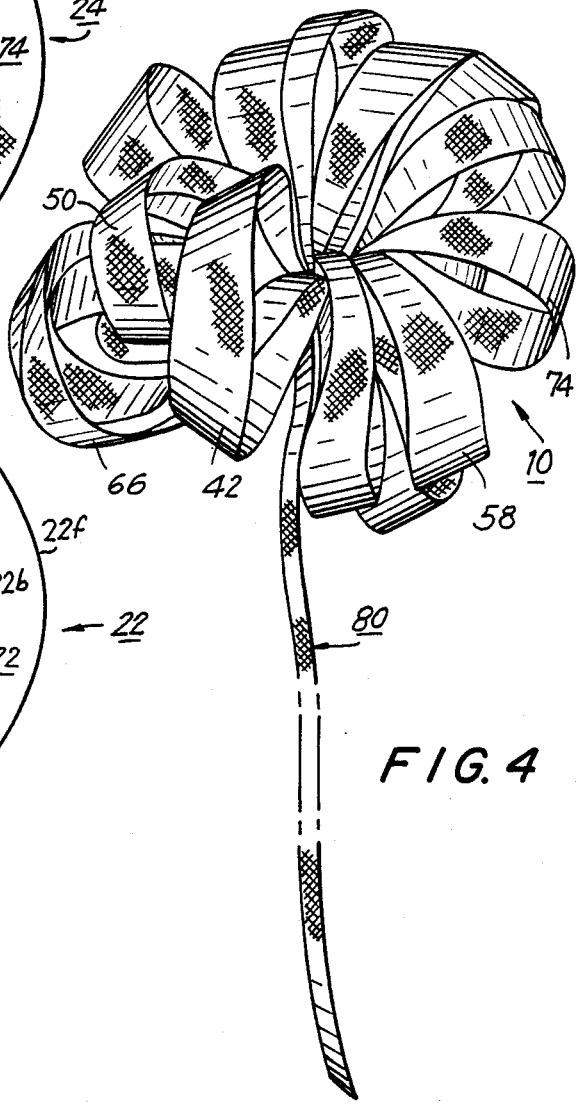
FIG. 4

DECORATIVE BOW ASSEMBLY AND METHOD OF MAKING SAME

BACKGROUND OF THE INVENTION

1. Field of the Invention

This invention generally relates to pull bows for forming a decorative bow for attachment to wrapped gifts, containers and the like and, more particularly, to a decorative bow having multiple loops arranged in an annulus by pulling on a drawstring having a short-travel stroke.

2. Description of Related Art

Ribbon and drawstring assemblies formable into decorative bows for attachment to wrapped gifts and containers are known, for example, in U.S. Pat. Nos. 4,515,837; 4,608,283; 4,476,168 and 2,841,905. A single ribbon strip folded over to form two ribbons at a common end, or a pair of ribbons joined at a common end, are each subdivided into ribbon sections arranged lengthwise along each ribbon. Clips, wires, apertures, bond, staples and analogous retainers are provided between each adjacent pair of ribbon sections. A drawstring is secured to the common end, and extends between and along the ribbons and loosely through the retainers. By pulling on the drawstring, each ribbon section is folded to form an arcuate loop. The more loops, the "fuller" is the bow thus formed.

Hence, in order to form a very full, and thus a more attractive, bow, the art has proposed very long ribbons to form many ribbon sections and, of course, this means a very long drawstring which has to be pulled over a very long pull or travel stroke. This is wasteful of material, and the long pull stroke presents added risk of the bow becoming torn, damaged or soiled during its formation.

Prior bow assemblies have also suffered from the drawback that,on pulling the drawstring, the ribbons tended to fold themselves into loops which were all aligned in one vertical plane, thus forming a fan shape. Since the user normally requires the bow to be arranged in a more decorative rosette or pompon form, the user had to rotate individual loops laterally and rearrange them so that the loops were spaced angularly around a central axis of the bow.

To overcome this time-consuming task, the art has resorted to mounting the aforementioned retainers at angles of inclination relative to the longitudinal axis along which each ribbon is elongated. Each retainer is advantageously oriented at an angle different from that of the adjacent preceding retainer. When the drawstring is pulled, instead of the loops tending to superimpose themselves one on the other, the successive loops arrange themselves at differing angles spaced around the central bow axis to provide the desired rosette form.

Although generally satisfactory for its purpose of forming a rosette bow, the mounting of retainers at different inclination angles has proven to be a time-consuming and labor-intensive task. For example, in U.S. Pat. No. 4,515,837, each ribbon has to be notched with V-shaped indentations offset from each other, and each retainer has to be separately mounted at different angles of inclination. In U.S. Pat. No. 4,476,168, inclined bonding areas of alternately reversed orientation have to be provided. In U.S. Pat. No. 4,608,283, spaced-apart weld areas have to be appropriately oriented. It would be simpler and less labor- and time-intensive if such retainers need not be inclined and, yet, not sacrifice the automatic formation of the rosette form.

SUMMARY OF THE INVENTION

Objects of the Invention

It is an object of this invention to overcome the drawbacks of the prior art pull bow assemblies.

It is another object of this invention to form a decorative bow having multiple loops without the necessity of providing an overlong drawstring and overlong ribbons.

A further object of this invention is to form a decorative bow having loops automatically arranged in a circular array to form a rosette without the necessity of using inclined retainers, or too many retainers.

Still another object of this invention is to form a decorative bow with a drawstring displaceable along a short pull or travel stroke.

Yet another object of this invention is to provide an inexpensive-to-manufacture pull bow.

Features of the Invention

In keeping with these objects, and others which will become apparent hereinafter, one feature of this invention resides, briefly stated, in a decorative bow assembly having a pair of elongated bow members of sheet material. The bow members extend along a longitudinal direction and have a common end. The bow members may be separate strips which are joined at the common end, or may be a single strip which is folded over at a unitary common end. The bow members are initially arranged in a collapsed, face-to-face relationship in a so-called bow-unformed position. Each bow member has at least one bow section, and preferably a plurality of bow sections, arranged lengthwise of the respective bow member. As explained below, the number of such bow sections is substantially less than that proposed by the prior art.

The invention further includes retainer or connector means for engaging the bow members at at least one location, and preferably a plurality of locations, spaced longitudinally away from the common end. The retainer means, e.g. a resilient clip, restrains movement of the bow members toward and apart of each other at each said location. The retainer means has an aperture which extends in a transverse direction of the bow members. As explained below, the number of such retainer means and said locations is substantially less than that proposed by the prior art, and the orientation of each retainer means is not provided at an angle of inclination relative to a longitudinal axis along which each bow member extends.

The invention also includes limited travel actuator means, including an elongated drawstring, for moving the bow members from the bow-unformed to a so-called bow-formed state in which the bow members form a three-dimensional, looped rosette or pompon configuration. One end of the drawstring is connected to the common end. The drawstring extends in the longitudinal direction between and along the bow members, and freely through the aperture for sliding movement relative to the bow members.

In accordance with this invention, each bow section is formed with a plurality of slits to form a plurality of loop-forming, longitudinally-extending elements on each bow section. Upon longitudinal displacement of the drawstring, each plurality of such loop-forming elements is folded to form individual loops which are automatically arranged in an annulus whose center lies on the longitudinal axis.

Heretofore, each bow section formed a single loop. Now, this invention proposes that each bow section be slit so that multiple loops are formed for each bow section.

Heretofore, in order to make a full bow composed of multiple loops, two very long ribbons or bow members, each composed of a multiple number of bow sections, were successively arranged along rows of very long length. Now, this invention proposes a much shorter length for each bow member, because a multiple number of bow sections serially arranged in a row is not needed to achieve a bow having the same number of loops.

Heretofore, the drawstring had to be at least as long as, and indeed longer than, the aforementioned very long bow members to form the bow. Now, this invention proposes that the drawstring have a much shorter travel or pull stroke, because the same number of loops can be formed with fewer bow sections and, hence, a shorter drawstring.

Heretofore, retainers had to be mounted at alternate reverse inclination angles to achieve the automatic forming of a rosette bow. Now, this invention proposes not only that fewer retainers be provided, because there are fewer bow sections, but also that the retainers not be mounted at such inclination angles. By forming the slits along curved courses at differing radii of curvature, and by symmetrically arranging the slits about the longitudinal axis, the elements will automatically form loops which are angularly arranged about the longitudinal axis.

The method of making the bow assembly is also new, and includes the steps of cutting first and second elongated strips from a sheet material blank, preferably the same blank. Each strip is cut with a plurality of bow sections in each of which a plurality of loop-forming elements are slit. The strips are positioned against each other, with the bow sections of the first strip in a face-to-face relationship with the bow sections of the second strip. A drawstring is connected to joined ends of the two strips. The strips are restrained at one or more locations spaced from the joined ends. The drawstring is routed between and along the strips and past each said location. The drawstring is freely movable relative to the strips along a limited travel path to fold the loop-forming elements of each slit bow section to form a decorative bow.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 1 is a perspective view of a sheet material blank placed in a stamping press to form a unitary strip;

FIG. 2 is a top plan view of the unitary strip stamped out of the press;

FIG. 3 is a front enlarged view of a pull bow assembly prior to formation; and

FIG. 4 is a front perspective view of the pull bow assembly after formation.

DETAILED DESCRIPTION OF THE PREFERRED EMBODIMENT

A decorative bow assembly 10 is shown in a bow-unformed state in FIG. 3 and in a bow-formed state in FIG. 4. The assembly is made as follows: Referring to FIG. 1, a single sheet material blank 12 of conventional decorative ribbon material, e.g. synthetic plastic having a satin-like fibrous texture, is placed in a stamping press between a movable ram 14 and a stationary base 16. A set of upstanding knives 18 is arranged in a predetermined pattern on the base. When the ram is moved in the direction of arrow A, the blank 12 is cut and slit by the knives 18, thereby resulting in a unitary strip 20 as shown in FIG. 2 after removal from the press.

The strip 20 has four oval-shaped bow sections 22, 24, 26, 28 arranged successively lengthwise of the strip 20 in a row along a longitudinal axis of symmetry B-B. The strip 20 has opposite free ends 30, 32 of narrow width, and constricted waists 34, 36, 38 also of narrow width. Each bow section has a variable width which is at its minimum at ends 30, 32 and waists 34, 36, 38. Bow sections 22, 28 have a maximum width between a respective end 30, 32 and a waist 34, 38. Bow sections 24, 26 have a maximum width between waists 34, 36, 38.

Bow sections 22, 24 constitute a first bow member, and bow sections 26, 28 constitute a second bow member. These bow members are unitarily joined at, and folded about, waist 36 which serves as a transverse fold line. Once folded, as shown in FIG. 3, bow sections 22, 28 are in face-to-face relationship, and bow sections 24, 26 are in face-to-face relationship. The ends 30, 32 dangle free, but the waist 36 serves as a common, joined end for the bow members.

Referring to FIG. 2, at the same time that the ovoidal bow sections are cut from the blank 12, a plurality of curved slits are slit into each bow section. Outer slits **22*a*, 22*b*; 24*a*, 24*b*; 26*a*, 26*b*; and 28*a*, 28*b* are formed in sections 22, 24, 26, 28**, respectively.

Inner slits **22*c*, 22*d*; 24*c*, 24*d*; 26*c*, 26*d*; and 28*c*, 28*d* are formed in sections 22, 24, 26, 28**, respectively.

Outer edges **22*e*, 22*f*; 24*e*, 24*f*; 26*e*, 26*f*; and 28*e*, 28*f* are provided at the edges of sections 22, 24, 26, 28**, respectively.

The slits and edges bound therebetween and form a plurality of elongated, loop-forming elements.

Oval elements 40, 42, 44, 46 are formed between slits **22*c*, 22*d*; 24*c*, 24*d*, 26*c*, 26*d*; and 28*c*, 28*d***, respectively.

Inner crescent-shaped elements 48, 50, 52, 54 are formed between slits **22*a*, 22*c*; 24*a*, 24*c*; 26*a*, 26*c*; and 28*a*, 28*c***, respectively, at one side of the axis.

Inner crescent-shaped elements 56, 58, 60, 62 are formed between slits **22*b*, 22*d*; 24*b*, 24*d*; 26*b*, 26*d*; and 28*b*, 28*d***, respectively, at the other side of the axis.

Outer crescent-shaped elements 64, 66, 68, 70 are formed between edges **22*e*, 24*e*, 26*e* and 28*e* and slits 22*a*, 24*a*, 26*a* and 28*a***, respectively, at one side of the axis.

Outer crescent-shaped elements 72, 74, 76, 78 are formed between edges **22*f*, 24*f*, 26*f* and 28*f* and slits 22*b*, 24*b*, 26*b* and 28*b***, respectively, at the other side of the axis.

Each element is elongated and has opposite ends which are drawn together about a transverse fold line intermediate its respective opposite ends during formation of a bow. Each element forms its own loop.

Turning to FIG. 3, a drawstring 80 has one end 82 fixedly secured to common end 36, and an opposite free end 84 serving as a handle by which one can grasp and pull the drawstring along its length. The drawstring can be made of a ribbon or string material which is narrower in width than the bow members. Two retaining clips 86, 88 of resilient plastic or wire material are snapped around juxtaposed waists 34, 38 and ends 30, 32, respectively. The clips engage the bow members at these narrow width locations of the bow members, and serve to restrain movement of the latter toward and apart of each other at said locations. Each clip has an aperture extending transversely, particularly perpendicular to, the longitudinal axis. The drawstring 80 is routed between and along the bow members and freely through each aperture of the clips 86, 88 wherein sufficient clearance exists for the drawstring to slide relative to the bow members when the drawstring is pulled.

In use, one pulls on the drawstring, thereby drawing common end 36 toward retainer 86 at juxtaposed waists 34, 38. Representative elements 66, 50, 42, 58, 74 fold about a transverse axis midway between their respective ends. Due to the crescent- and oval-shaped nature of elements 66, 50, 42, 58, 74 at one side of the axis B—B, and of elements 68, 52, 44, 60, 76 at the other side of the axis B—B, the folded-over elements are automatically angularly arranged about this axis in an annulus whose center is on the axis.

Continued pulling of the drawstring causes retainer 86 to be drawn toward retainer 88 at juxtaposed ends 30, 32. In analogous manner, elements 64, 48, 40, 56, 72 at one side of the axis, and elements 70, 54, 46, 62, 78 at the other side of the axis are each folded and automatically angularly arranged about the axis in an annulus whose center is on the axis.

The bow 10 so formed is shown in FIG. 4. The free end of the drawstring 80 can be cut off, if desired.

The present invention is not intended to be limited to the four bow sections illustrated, since even two such sections could be employed to form a satisfactory bow. More than four sections could also be employed. Nor is the invention to be limited to four slits in each bow section. One slit would be sufficient to form a plurality of elements and, of course, more than four slits could be used. Nor is the invention to be restricted to ovoidal sections, since many other configurations are possible. The slits need not be curved as shown, but could have many different courses, including a linear course.

It will be noted that multiple, e.g. ten, loops are formed for each pair of juxtaposed bow sections intermediate a pair of retainers, whereas heretofore only two loops were formed. Whereas, in the prior art, five pairs of serially-arranged juxtaposed bow sections were necessary to obtain ten loops, the present invention achieves the same number of loops with but one pair of juxtaposed bow sections. The length of each bow member is shorter; the length of the drawstring is shorter; and the travel or pull stroke of the drawstring is shorter. Fewer retainers are necessary and, as described previously, the retainers of the present invention need not be, and preferably are not, inclined relative to the longitudinal axis. Each retainer is preferably constituted by clips or staples, or by bonding spots, although other types of connectors could be utilized. Each clip or staple is formed, or bent to form, the aforementioned aperture in which a respective pair of juxtaposed waists or ends is received, together with the drawstring. A pair of bonding spots, also known as welds, is transversely spaced apart on the juxtaposed bow members to form the aforementioned aperture in said spacing. Of course, the retainers could also be inclined relative to the longitudinal axis in order to facilitate the angular arrangement of the bow loops about the longitudinal axis.

The present invention is also not intended to be limited to a single strip folded over to form two bow members, or to two discrete bow members juxtaposed with each other, the two bow members and a drawstring being interconnected by a retainer as described above. Instead, a single bow member connected at spaced apart locations along its length to a drawstring could likewise be employed to form a satisfactory bow upon pulling the drawstring. For example, rather than folding the strip depicted in FIG. 2 at waist 36, the drawstring 80 could be mounted lengthwise of the single strip and connected by retainers provided at ends 30, 32 and waists 34, 36, 38. This single strip construction could be fan-folded in a compact form, or be wound in a roll, whereby a user could pay out the number of bow sections desired and cut the strip at the desired length.

It will be understood that each of the elements described above, or two or more together, also may find a useful application in other types of constructions differing from the types described above.

While the invention has been illustrated and described as embodied in a decorative bow assembly and method of making same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A decorative bow assembly, comprising:

(A) a pair of elongated bow members of sheet material movable relative to each other from a bow-unformed position in which the bow members are in a collapsed, face-to-face state, to a bow-formed position in which the bow members form a three-dimensional, looped state, (i) said bow members extending along a longitudinal direction and having a common end, (ii) each bow member having at least one bow section having opposite outer edges and a plurality of slits extending between the outer edges and forming a plurality of loop-forming, longitudinally-extending elements one each bow section;

(B) connector means engaging the bow members at a location spaced longitudinally away from the common end, for restraining movement of the bow memebers toward and apart of each other at said location.

(i) said connector means having an aperture extending in a transverse direction of the bow members; and (C) limited travel actuator means for moving the bow members from the bow-unformed to the bow-fromed position, including an elongated drawstring having one end connected to the common end extending in the longitudinal direction between the bow members and freely through the aperture, (i) said drawstring being displaceable in the longitudinal direction along a limited travel path for folding the plurality of loop-forming elements of each slit bow section to form a decorative bow having multiple loops arranged in an annulus at the end of said path.

2. The decorative bow assembly of claim 1, wherein each bow member includes a plurality of oval-shaped bow sections arranged in a row along the longitudinal direction.

3. The decorative bow assembly of claim 2, wherein each bow section has outer curved edges, and wherein each slit extends along a curved course.

4. The decorative bow assembly of claim 3, wherein each bow section is symmetrical about a longitudinal axis extending centrally along a respective bow member.

5. The decorative bow assembly of claim 4, wherein each bow section has outer crescent-shaped elements and an interior oval-shaped element.

6. The decorative bow assembly of claim 1, wherein each bow member has outer, non-linear, scalloped edges.

7. The decorative bow assembly of claim 1, wherein said bow members are formed from a single cut blank of sheet material, and are folded over at the common end.

8. The decorative bow assembly of claim 1, wherein the aperture lies in a plane perpendicular to the longitudinal direction.

9. A decorative bow assembly, comprising:

(A) a bow member of sheet material movable from a bow-unformed position in which the bow member is in a collapsed state, to a bow-formed position in which the bow member forms a three-dimensional looped state, (i) said bow member extending along a longitudinal direction and having an end, (ii) said bow member having at least on bow section having opposite outer edges and a plurality of slits extending between the outer edges and forming a plurality of loop-forming, longitudinally-extending elements on each bow section;

(B) connector means engaging the bow member at a location spaced longitudinally away from said end, said connector means having an aperture extending in a transverse direction of the bow member; and (C) limited travel acuator means for moving the bow member from the bow-unformed to the bow-formed position, including an elongated drawstring having one end connected to said end and extending in the longitudinal direction along the bow member and freely through the aperture, (i) said drawstring being displaceable in the longitudinal direction along a limited travel path for folding the plurality of loop-forming elements of each slit bow section to form a decorative bow having multiple loops at the end of said path.

10. A decorative bow assembly, comprising:

(A) a pair of elongated bow members of sheet material movable relative to each other from a bow-unformed position in which the bow members are in a collasped, face-to-face state, to a bow-formed position in which the bow members form a three-dimensional, looped state, (i) said bow members extending along a longitudinal direction and having a common end, (ii) each bow member having at least one bow section having opposite outer edges and a plurality of slits extending between the outer edges and forming a plurality of loop-forming, longitudinally-extending elements on each bow section;

(B) aperture means located at a location spaced longitudinally away from the common end, and extending in a transverse direction of the bow member; and (C) limited travel actuator means for moving the bow members from the bow-unformed to the bow-formed position, including an elongated drawstring having one end connected to the common end and extending in the longitudinal direction between the bow members and freely through the aperture means, (i) said drawstring being displaceable in the longitudinal direction along a limited travel path for folding the plurality of loop-forming elements of each slit bow section to form a decorative bow having multiple loops arranged in an annulus at the end of said path.

11. A decorative bow assembly, comprising:

(A) a bow member of sheet material movable from a bow-unformed position in which the bow member is in a collapsed state, to a bow-formed position in which the bow member forms a three-dimensional looped state, (i) said bow member extending along a longitudinal direction and having an end, (ii) said bow member having at least one bow section having opposite outer edges and a plurality of slits extending between the outer edges and forming a plurality of loop-forming, longitudinally-extending elements on each bow section:

(B) aperture means located at a location spaced longitudinally away from said end, and extending in a transverse direction of the bow member; and (C) limited travel actuator means for moving the bow member from the bow-unformed to the bow-formed position, including an elongated drawstring having one end connected to said end and extending in the longitudinal direction along the bow member and freely through the aperture means, (i) said drawstring being displaceable in the longitudinal direction along a limited travel path for folding the plurality of loop-forming elements of each slit bow section to form a decorative bow having multiple loop at the end of said path.

* * * * *